US007854099B2

(12) United States Patent
Kidd

(10) Patent No.: US 7,854,099 B2
(45) Date of Patent: Dec. 21, 2010

(54) SYSTEM FOR ATTACHING PREFABRICATED ARCHITECTURAL PANELS

(76) Inventor: Russell Kidd, 47134 Far West Ave., Paisley, FL (US) 32767

( * ) Notice: Subject to any disclaimer, the term of this patent is extended or adjusted under 35 U.S.C. 154(b) by 306 days.

(21) Appl. No.: 12/106,664

(22) Filed: Apr. 21, 2008

(65) Prior Publication Data

US 2008/0256882 A1 Oct. 23, 2008

Related U.S. Application Data

(60) Provisional application No. 60/913,410, filed on Apr. 23, 2007.

(51) Int. Cl.
*E04B 2/88* (2006.01)
*E04B 2/90* (2006.01)

(52) U.S. Cl. ..... 52/489.1; 52/475.1; 52/235; 52/506.05

(58) Field of Classification Search ..... 52/235, 52/475.1, 489.1, 483.1, 506.05, 506.06, 506.08, 52/506.09, 509, 511, 512, 513, 745.1, 747.12
See application file for complete search history.

(56) References Cited

U.S. PATENT DOCUMENTS

| | | | | | |
|---|---|---|---|---|---|
| 2,139,322 | A * | 12/1938 | Miner | 52/474 |
| 2,251,991 | A * | 8/1941 | Fellner | 52/506.08 |
| 2,377,211 | A * | 5/1945 | Cocken, Jr. | 404/40 |
| 2,379,269 | A * | 6/1945 | Barrows | 52/512 |
| 2,859,843 | A * | 11/1958 | Allen | 52/512 |
| 2,862,585 | A * | 12/1958 | McChesney | 52/474 |
| 3,020,988 | A * | 2/1962 | Bransford, Jr. | 52/512 |
| 3,081,853 | A * | 3/1963 | Buttriss | 52/512 |
| 3,290,847 | A * | 12/1966 | Fenwick | 52/489.1 |
| 3,742,667 | A * | 7/1973 | Tofani, Jr. | 52/235 |
| 4,307,551 | A * | 12/1981 | Crandell | 52/235 |
| 4,394,809 | A * | 7/1983 | Sherwood et al. | 52/512 |
| 4,506,484 | A * | 3/1985 | Bartlett et al. | 52/476 |
| 4,597,235 | A * | 7/1986 | Olsen | 52/509 |
| 4,607,471 | A * | 8/1986 | Olsen | 52/509 |
| 4,622,794 | A * | 11/1986 | Geortner | 52/396.05 |
| 4,685,263 | A * | 8/1987 | Ting | 52/235 |
| 5,063,718 | A * | 11/1991 | Nonis | 52/235 |
| 5,067,300 | A * | 11/1991 | Takeda | 52/745.1 |
| 5,212,914 | A * | 5/1993 | Martin et al. | 52/235 |
| 5,226,274 | A * | 7/1993 | Sommerstein | 52/512 |
| 5,239,798 | A * | 8/1993 | Saito | 52/235 |
| 5,265,396 | A * | 11/1993 | Amimoto | 52/745.12 |
| 5,379,561 | A * | 1/1995 | Saito | 52/235 |
| 5,522,193 | A * | 6/1996 | Sommerstein et al. | 52/235 |
| 5,544,461 | A * | 8/1996 | Sommerstein | 52/235 |
| 5,687,526 | A * | 11/1997 | Benvenuto et al. | 52/506.08 |
| 6,035,598 | A * | 3/2000 | Sukolics et al. | 52/506.08 |
| 6,098,364 | A * | 8/2000 | Liu | 52/506.08 |
| 7,562,509 | B2 * | 7/2009 | Ness | 52/800.11 |

* cited by examiner

*Primary Examiner*—Phi Dieu Tran A
(74) *Attorney, Agent, or Firm*—Krugliak, Wilkins, Griffiths & Dougherty Co., L.P.A.; Brent L. Moore

(57) ABSTRACT

A system for attaching architectural panels to the outer surface of a residential or commercial building includes a vertically disposed stiffener attached to a panel and also to the outer surface of the building. The stiffener interlocks with a base clip which is attached to an adjacent upper panel. A vertically disposed bracket and a clip are each attached to opposite edges of the panel. The vertically disposed bracket and the clip engage a second clip and a second bracket, respectively, in an adjacent panel in order to attach the panel to the outer surface of the building.

10 Claims, 13 Drawing Sheets

SYSTEM FOR ATTACHING PREFABRICATED ARCHITECTURAL PANELS

This application claims the benefit of U.S. Provisional Application No. 60/913,410 filed on Apr. 23, 2007.

BACKGROUND OF THE INVENTION

1. Field of the Invention

The invention relates generally to the art of architectural products for buildings and in particular to non-structural or aesthetic architectural panel wall systems which are applied to buildings in order to replace heretofore traditional outer-coverings such as brick or stucco. More particularly, the invention relates to a novel support system for prefabricated architectural panels of a panel wall system along with a method for attaching the same onto the outermost surface of a building and/or architectural structure, suitable for use in commercial, residential and industrial buildings.

2. Background Art

The exterior walls of commercial, residential, and industrial buildings are typically made from concrete block or stud-formed walls. The exterior surface of these walls is typically covered by an outer covering such as brick or stucco, in order to make the outside of the building more aesthetically pleasing to the eye. However, brick is expensive and requires extensive labor costs to properly apply it to the exterior of the building. Moreover, stucco, although cheaper to apply to the exterior of the building than brick, requires painting and does not provide the smooth exterior surface that is often desired by architects. In order to overcome these deficiencies, other methods of covering the exterior surfaces of buildings have been developed.

Panel-type exterior wall systems are well known in the art and are useful for finishing the exteriors of commercial and/or industrial buildings. Panel-type exterior wall systems typically include a multiplicity of pan-like rectangular panels arranged side-by-side and end-to-end adjacent one another in a relatively closely spaced relation. Each panel includes a flange around its perimeter which extends toward the buildings exterior surface. More particularly, in order to create the perimeter flange, a router is used to score around the perimeter of the panel and the outer perimeter portion of the panel is then bent to a generally 90° angle relative to the panel face to form the pan. This system is generally known as a "route and return" system to those having skill in the art. A silicon-based sealant is then applied at the joint between each of the panels which allows for expansion and contraction of the joint. Panel-type exterior wall systems provide the building with an improved resistance to weather, including wind and water, and also provide an attractive finish to the exterior of the building.

One particular type of exterior panel wall system utilizes individual prefabricated panels that are suitably attached or fastened to the building framing by an attachment system. More particularly, composite aluminum panels of the shape and description set forth above and composed of two thin aluminum skins laminated to a plastic core which are generally about 4 mm in overall thickness are joined to the building framing by a framework of stiffener-retainers and stiffeners. These panels are typically rectangular or square in shape and are capable of being manufactured in various sizes. Typical panels measure from about 12-15 feet in length and 3-5 feet in height; of course, other varying shapes and dimensions of the panels are possible.

These types of paneled exterior wall systems have become popular in climates where the buildings to which the wall systems are attached are exposed to both high wind and increased quantities of rain. In these situations, the paneled wall systems must serve as a barrier to weather and water infiltration. One such area where the systems have become popular is the Miami-Dade region of the southern portion of Florida. This particular region of the country is known for its exposure to hurricanes which develop in the Atlantic Ocean and often cut a path through the southern region of Florida. Because hurricanes typically have winds that exceed 100 mph, regulations have been implemented by governing authorities in the region that require paneled wall systems applied to the exterior of buildings to withstand certain minimum testing requirements. More particularly, the Miami-Dade region of Florida is known as a "High Velocity Hurricane Zone". Because of these regulatory guidelines, few prior art paneled wall systems have been certified as meeting the minimum requirements of the region.

One such prior art system includes a series of horizontally-spaced interlocking stiffener-retainers and stiffeners in which the stiffener-retainers are attached to the exterior surface of the building. In turn the stiffeners are attached to the aluminum composite panel and the cooperation of the stiffener-retainers with the stiffeners allows the aluminum composite panels to be supported on the exterior of the building. More particularly, horizontally-spaced, longitudinally extending stiffener retainers are fastened by a suitable means, such as screws, to the exterior of the building. Similarly, horizontally-spaced, longitudinally-extending stiffeners are adhered to the composite aluminum panels by a suitable adhesive such as silicon. The stiffener-retainers and stiffeners interlock such that the composite panels then can be held on the exterior surface of the building. A continuous aluminum extrusion is attached to and extends around the perimeter of the composite panel. More particularly, a pair of female continuous aluminum extrusions are attached to two perimeter sides of the composite panel and a pair of male continuous aluminum extrusions are attached to the remaining two perimeter sides of the panel. More particularly, the pair of female continuous aluminum extrusions are fixedly attached to both the composite panel and the exterior of the building while the male continuous aluminum extrusions are attached only to the composite panel. The end result being that as the panels are assembled and attached onto the exterior of the building, two sides of each composite panel are floating and two sides are fixed to the building. This particular attachment system is difficult to install because it requires each horizontally-spaced longitudinally-extending stiffener retainer to be suitably attached to the exterior of the building. Because the stiffener retainers are typically spaced every sixteen inches, for a composite panel that is 5 feet high, at least 3 such retainers would need to be installed as well as the additional continuous aluminum extrusions around the perimeter of each composite panel.

Thus, a need exists in the art for a system to attach architectural panels to the exterior of a building in regions where hurricanes are likely to occur, such as the Miami-Dade region of Florida, which minimizes the cumbersome installation requirements of the prior art systems and conserves materials yet still provides an equivalent level of structural stability for the panels and which will still meet the minimum regulations and requirements set forth by the governing authorities for application of the panels. A need also exists in the art for a system to attach architectural panels to the exterior of a building in regions where hurricanes are not likely to occur, which minimizes the cumbersome installation requirements of the prior art systems and conserves materials yet still provides an equivalent level of structural stability for the panels.

These improvements are provided by the system for attaching architectural panels of the present invention which minimizes the cumbersome installation requirements of the prior art systems and minimizes material usage through the utilization of novel vertically disposed one-piece vertical tube stiffeners that incorporate the functional aspects of the prior art stiffener-retainers and stiffeners into one piece and which serve as the female for the required expansion and contraction joint thereby eliminating the need for a separate female continuous aluminum extrusion which is required by prior art systems.

These improvements are also provided by the system for attaching architectural panels of the present invention which minimizes the cumbersome installation requirements of the prior art systems and minimizes material usage through utilization of novel female brackets and male clips which replace the male and female continuous aluminum extrusions of the prior art.

SUMMARY OF THE INVENTION

The objectives of the present invention include providing a system for attaching prefabricated architectural panels to a residential or commercial building which minimizes the cumbersome installation requirements of prior art systems.

Another objective of the present invention includes providing a system for attaching prefabricated architectural panels to a residential or commercial building which conserves materials yet still provides an equivalent or better level of structural stability over prior art systems and which will still meet the minimum regulations and requirements set forth by the governing authorities for regions where hurricanes are likely to occur.

Yet another objective of the present invention includes providing a system for attaching prefabricated architectural panels to a residential or commercial building which minimizes materials usage through the utilization of vertically disposed one-piece vertical tube stiffeners that incorporate the structural and functional aspects of the prior art to eliminate the two-piece construction of the prior art systems.

Even yet another objective of the present invention includes providing a system for attaching prefabricated architectural panels to a residential or commercial building which minimizes materials usage and cumbersome installation requirements of prior art systems through the utilization of female brackets and male clips which replace the continuous aluminum extrusions of the prior art.

These objectives and advantages are obtained by the system for attaching architectural panels of the present invention which includes at least one stiffener fixedly attached to a panel and to an outer surface of a building, the stiffener interlocking with a base clip which is fixedly attached to an adjacent panel. A bracket being formed with an elongated opening, the bracket being attached to a first edge portion of the panel. A clip attached to a second edge portion of the panel. The opening of the bracket interlocking with a second clip attached to a first adjacent panel, the male clip interlocking with a second bracket of a second adjacent panel for attaching the panel to the building.

These objectives and advantages are also obtained by the method for attaching architectural panels of the present invention which includes the steps of: attaching a first base clip to a first edge of a first panel; attaching a stiffener to the first panel; the stiffener interlocking with the first base clip; attaching a first bracket having an elongated opening to a second edge of the first panel; attaching a first clip to a third edge of the first panel; interlocking the stiffener with a second base clip attached to an edge portion of an adjacent panel; interlocking the first clip with a second bracket having an elongated opening and being attached to an edge of an adjacent panel; interlocking the first bracket with a second clip attached to an edge of an adjacent panel; and attaching an end portion of the stiffener to the outer surface of the building.

These objectives and advantages are also obtained by the system for attaching architectural panels including at least one bracket being formed with an elongated opening, the bracket being attached to a first edge portion of a panel, the bracket being fixedly attached to an outer surface of a building. At least one clip attached to a second edge portion of the panel. The opening of the bracket interlocking with a second clip attached to a first adjacent panel, the clip interlocking with a second bracket of a second adjacent panel, for securing said panel to said building.

These objectives and advantages are also obtained by the method for attaching architectural panels to an outer surface of a building including the steps of: attaching a first bracket having an elongated opening to an outer surface of a building; attaching a first clip to a second edge of the first panel; interlocking the first clip with a second bracket having an elongated opening and being attached to the outer surface of the building; interlocking the first bracket with a second clip attached to an edge of a second adjacent panel; and attaching the first bracket to a first edge of a first panel.

BRIEF DESCRIPTION OF THE DRAWINGS

Preferred embodiments of the invention, illustrative of the best mode in which applicant has contemplated applying the principles, are set forth in the following description and are shown in the drawings and are particularly and distinctly pointed out and set forth in the appended claims. The various aspects of the present invention can be best understood by reference to the detailed description of the preferred embodiments set forth below taken with the drawings, in which:

Figure 6:
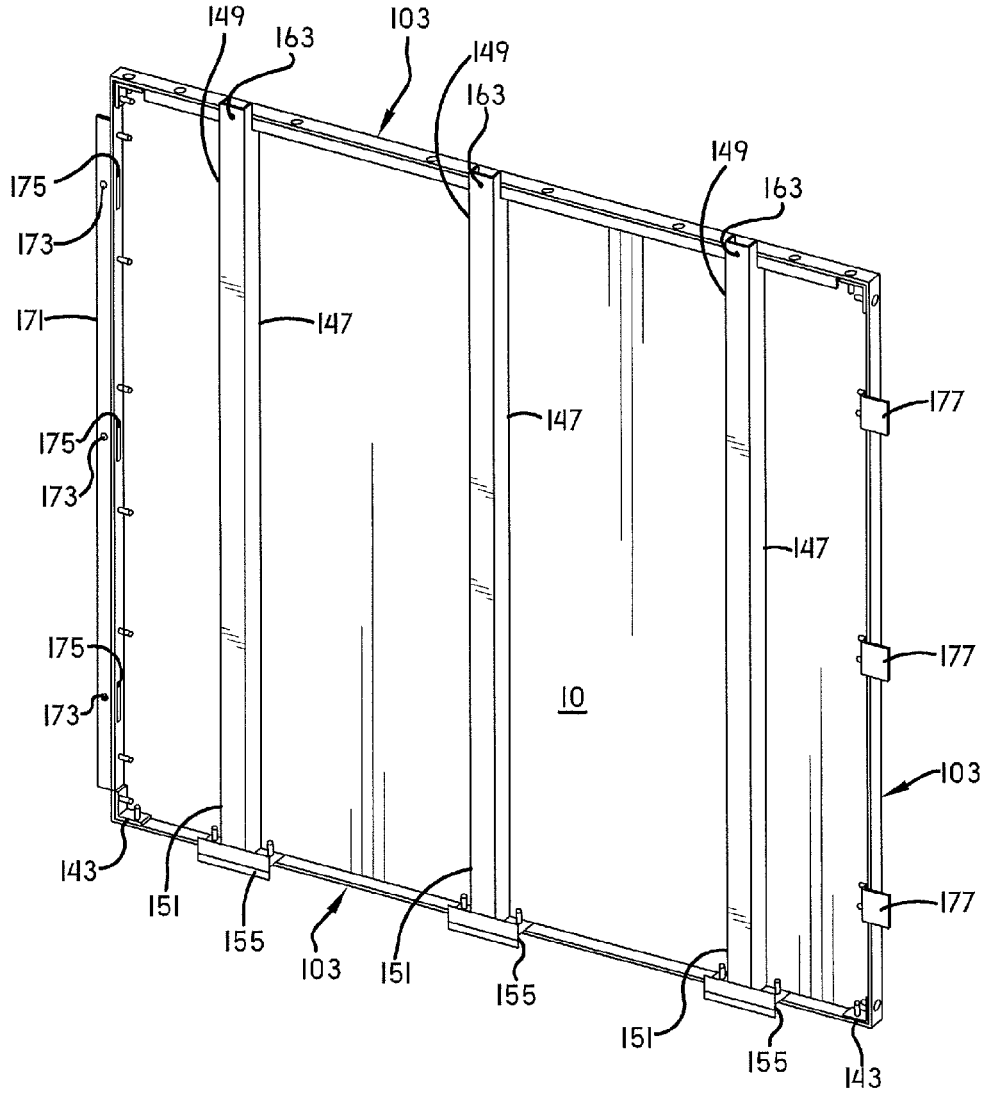
Figure 7:
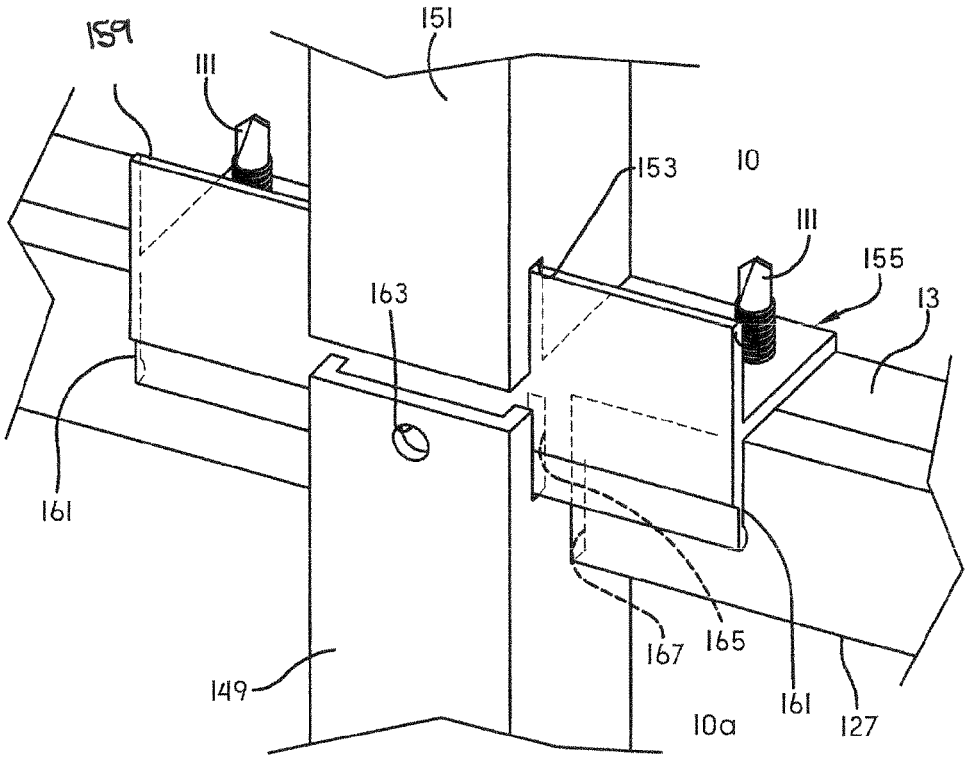
Figure 8:
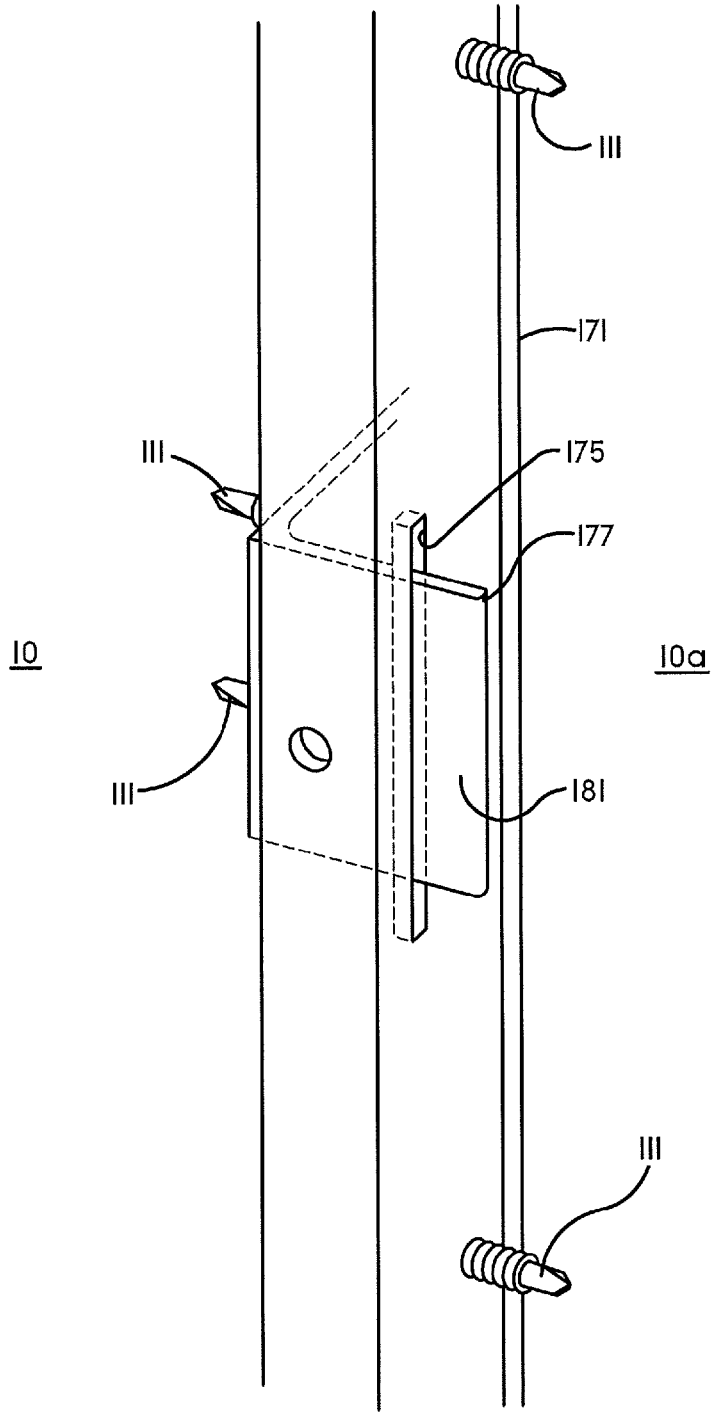
Figure 9:
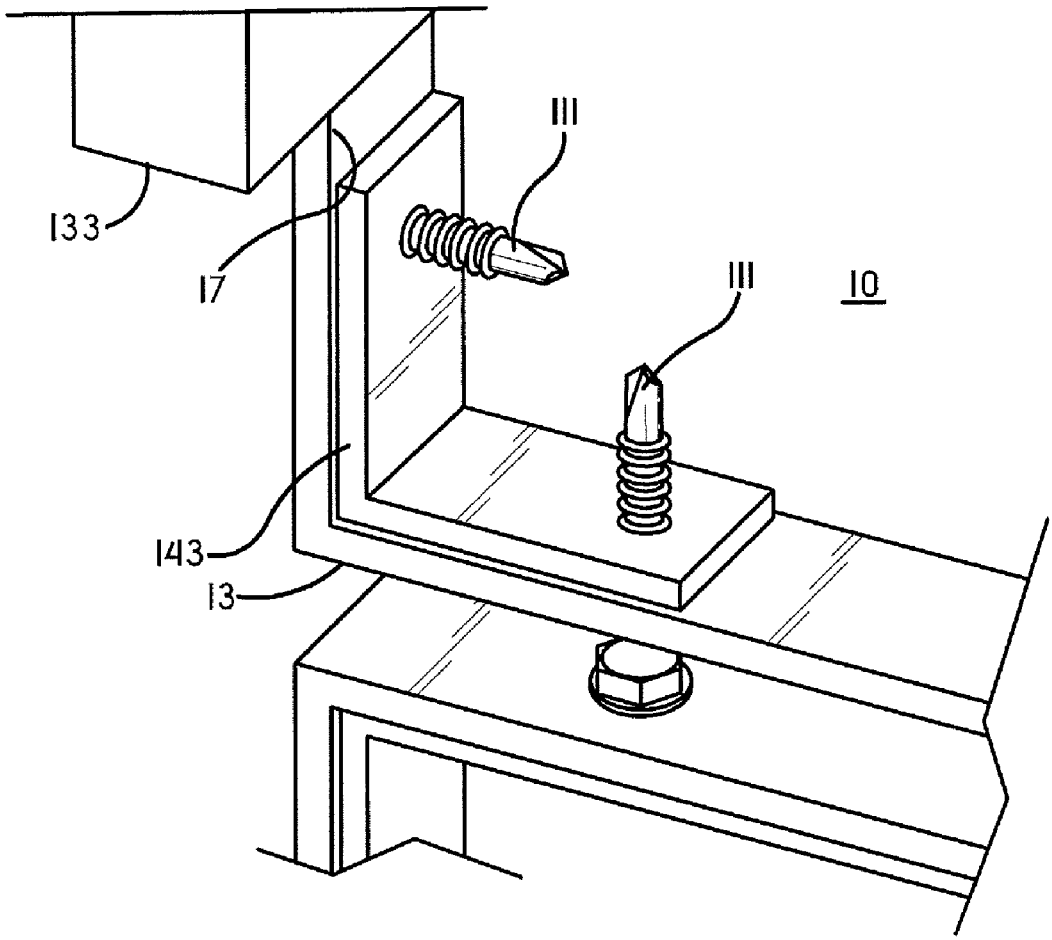
Figure 10:
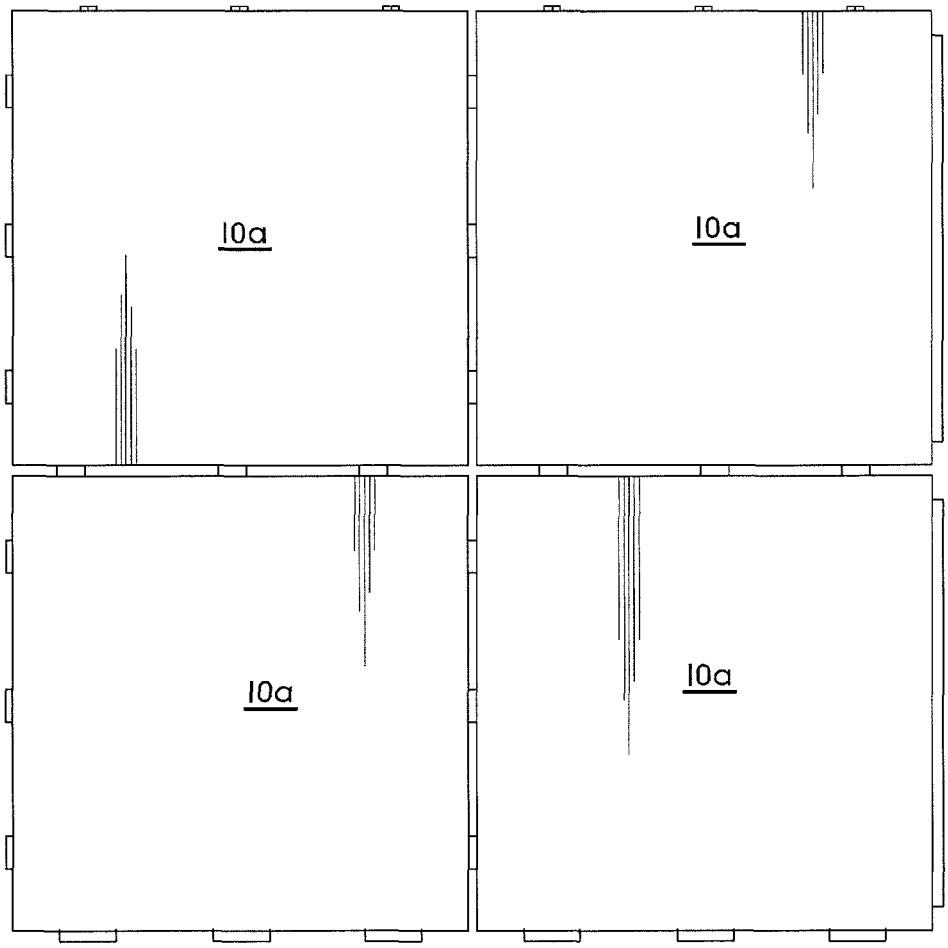
Figure 11:
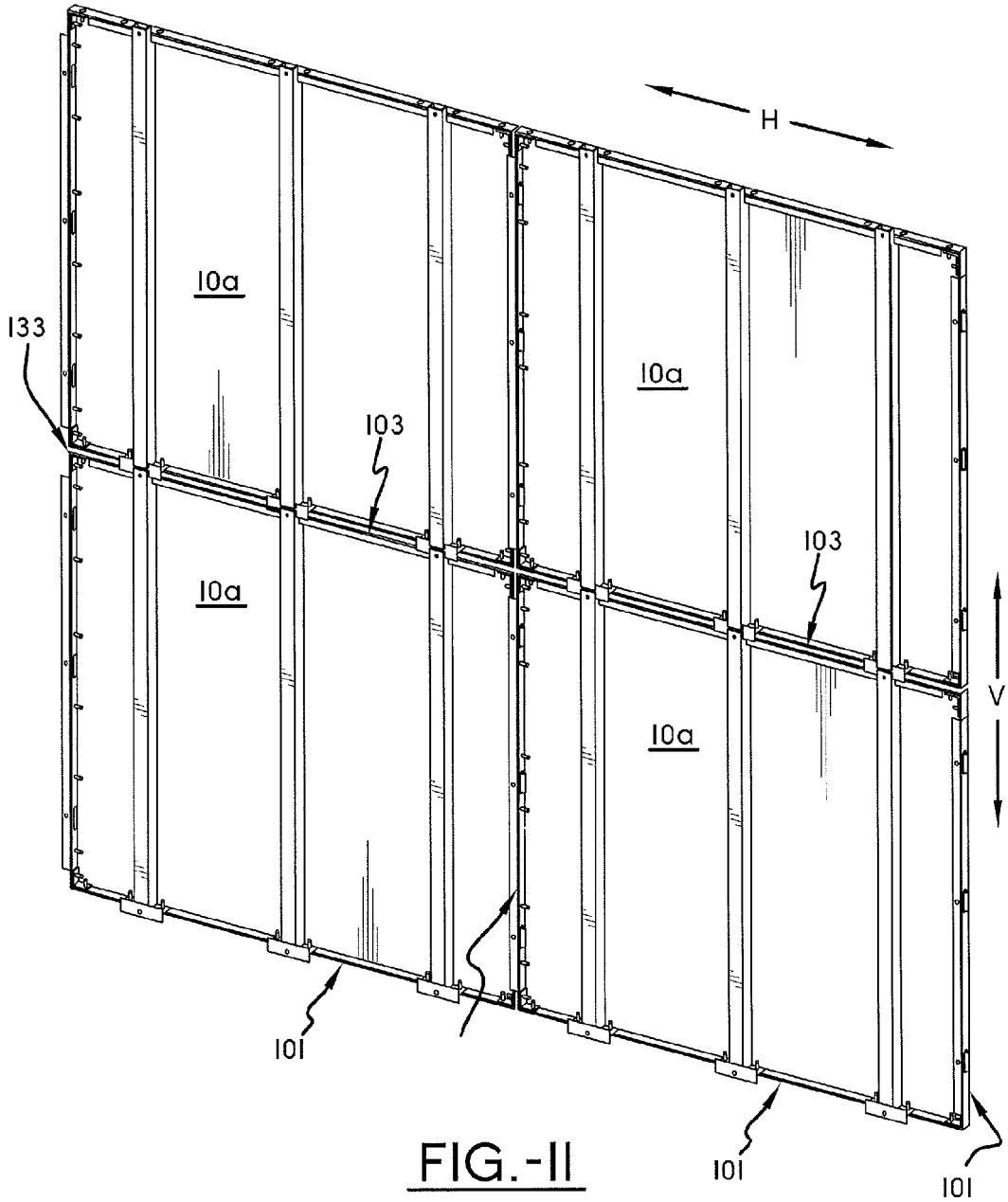
Figure 12:
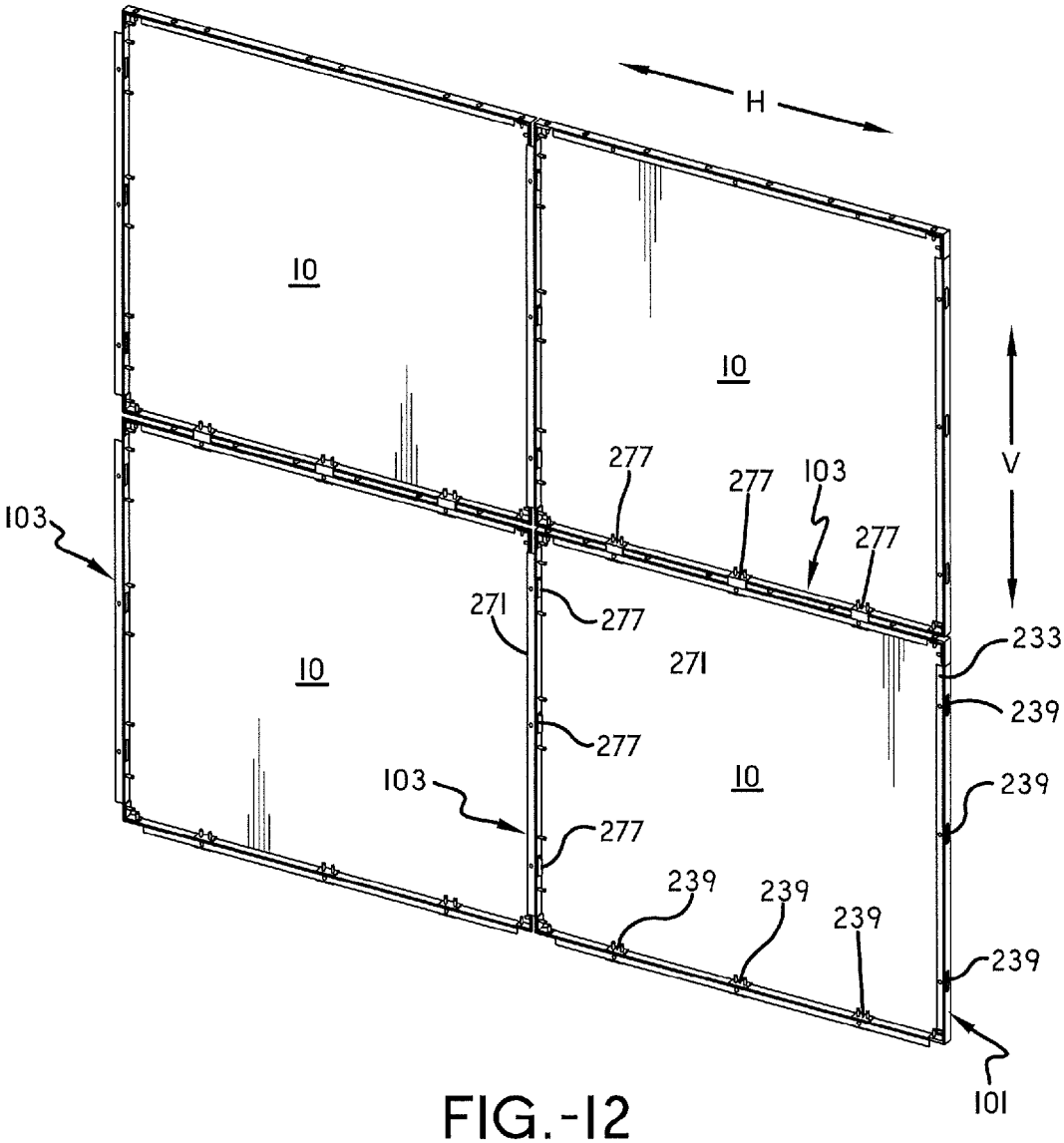
Figure 13:
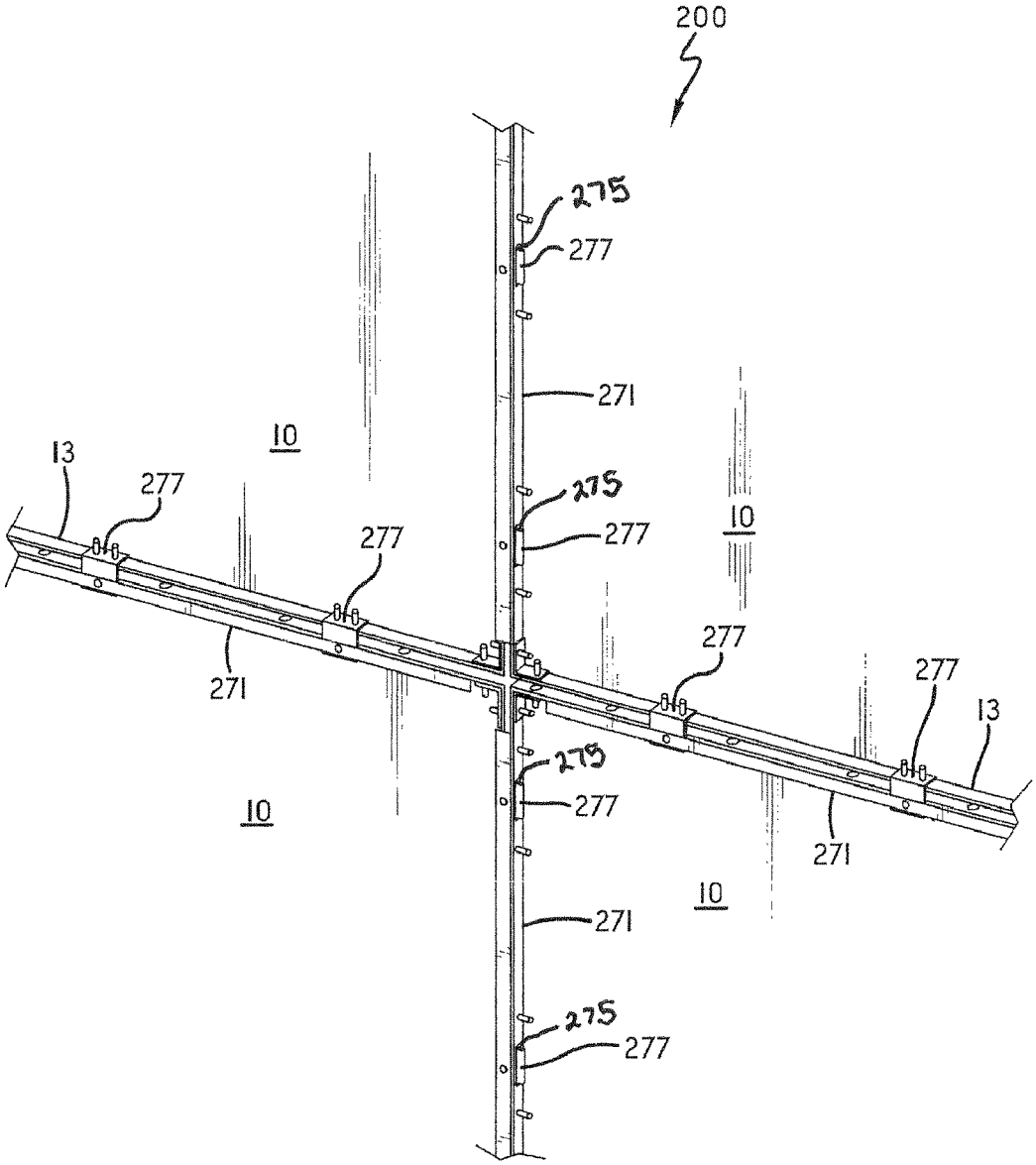

FIG, 6 is a perspective view of a portion of the first preferred embodiment architectural panel attachment system of the present invention, showing the underside of a regular composite panel and showing three vertical tube stiffeners, three base clips, three male clips, a female bracket, a pair of angle supports and four corner brackets;

FIG. 7 is an enlarged perspective view of a portion of the first preferred embodiment architectural panel attachment system shown in FIG.6, showing two vertical tube stiffeners cooperating with a base clip;

FIG. 8 is an enlarged perspective view of a portion of the first preferred embodiment architectural panel attachment system shown in FIG.6, showing a portion of a female bracket cooperating with a male clip;

FIG. 9 is an enlarged perspective view of a portion of the first preferred embodiment architectural panel attachment system of the present invention, showing the corner brace attached to the composite panel;

FIG. 10 is an elevational view of the first preferred embodiment architectural panel attachment system of the present invention, showing the joints between four adjacent panels;

FIG. 11 is a perspective view of a portion of the first preferred embodiment architectural panel attachment system of the present invention, showing several adjacent architectural panels;

FIG. 12 is a perspective view of a portion of a second preferred embodiment architectural panel attachment system of the present invention, showing the underside of a terminating panel and showing two terminating female brackets cooperating with their associated male clips attached to adjacent panels; and FIG. 13 is an enlarged perspective view of a portion of the second preferred embodiment architectural panel attachment system show in FIG. 12, showing adjacent non-terminal panels joined to one another by the attachment system.

Similar numerals refer to similar parts throughout the drawings.

DESCRIPTION OF THE PREFERRED EMBODIMENTS

Figure 1:
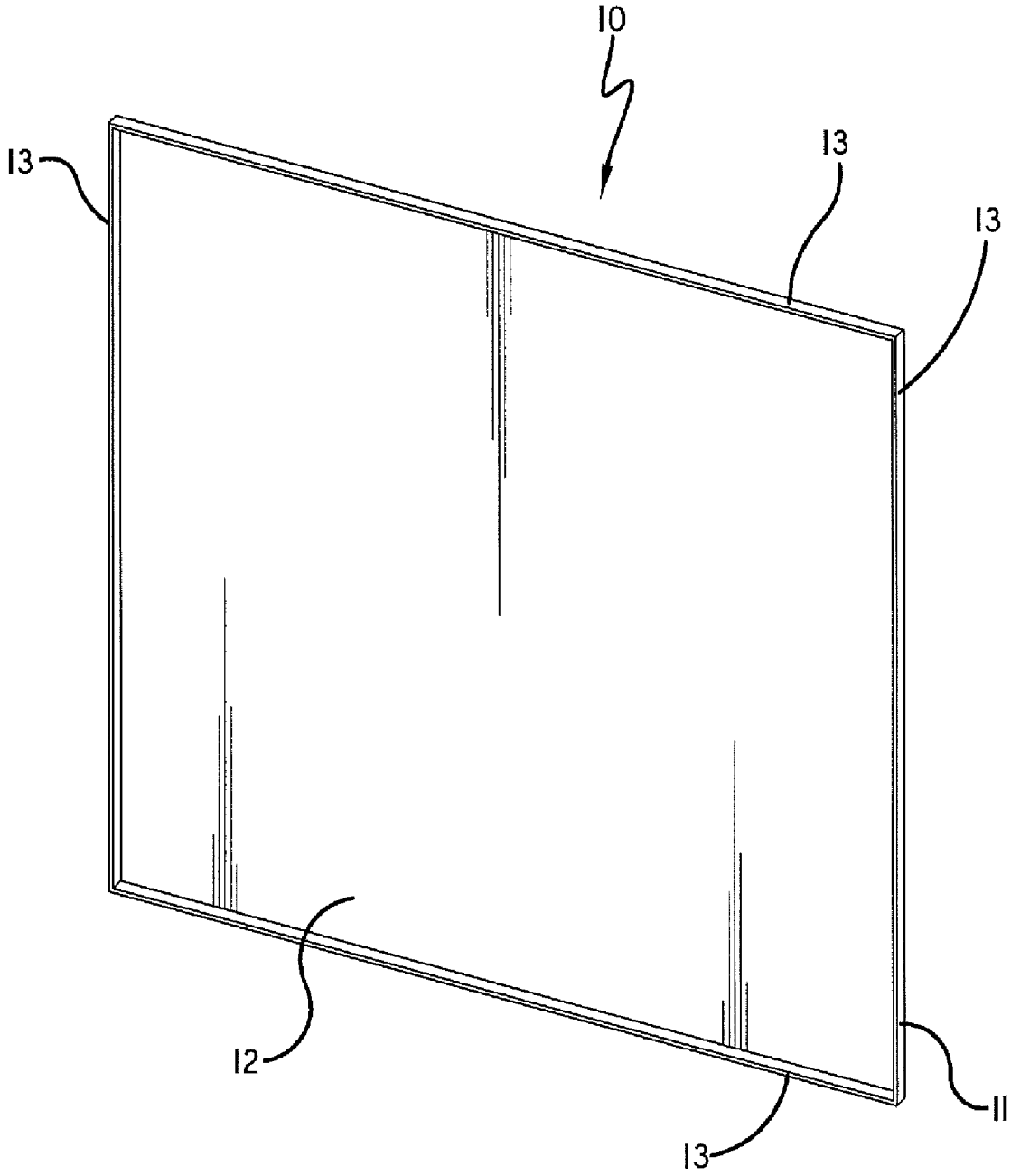
FIG. 1 is a perspective view of an aluminum composite panel, showing the outer surface of the panel and the flanges which extend toward the building structure around the perimeter of the panel.

In order to better understand the environment in which the attachment system of the present invention is utilized, a portion of a typical aluminum composite panel 10 is shown in FIG. 1 and now will be described. Composite panel 10 is a generally rectangular or square shaped panel composed of a pair of aluminum skins 11, 12, which sandwich a plastic core (not shown). Aluminum skin 11 forms the exterior surface of composite panel 10 and aluminum skin 12 forms the interior surface of the composite panel. Flanges 13 are located around the entire perimeter of composite panel 10 and are formed by the "route and return" method described above and generally well known to those having skill in the art. When composite panel 10 is attached to the exterior surface of a building (not shown), flanges 13 extend toward the building structure.

Turning now to FIGS. 2-11, a first preferred embodiment of a composite panel attachment system of the present invention is indicated generally at 100, and is shown attached to composite panels 10 of the type shown in FIG. 1. First embodiment attachment system 100 of the present invention generally includes both terminal and non-terminal support components for composite panels 10, the word "terminal" designating that there are no other adjacent composite panels relative to a certain side of the composite panel. More particularly, turning now to FIG. 2, a composite panel 10 having a pair of terminal sides 101 and a pair of non-terminal sides 103 is shown. Of course, it is understood that a composite panel 10 may also have more or less than a pair of terminal sides 101, such as only one terminal side or three terminal sides. Composite panel 10*a* shown in FIG. 11 is such a composite panel, having only one terminal side 101.

First embodiment attachment system 100 of the present invention also generally includes both vertical and horizontal support components. Vertical support components are those support components that hold composite panel 10 fixed in a vertical plane V (FIG. 11). Horizontal support components are those support components that hold composite panel 10 fixed in a horizontal plane H (FIG. 11). Unless otherwise noted, all components of first embodiment attachment system 100 of the present invention are formed from aluminum or other suitable robust material.

Figure 2:
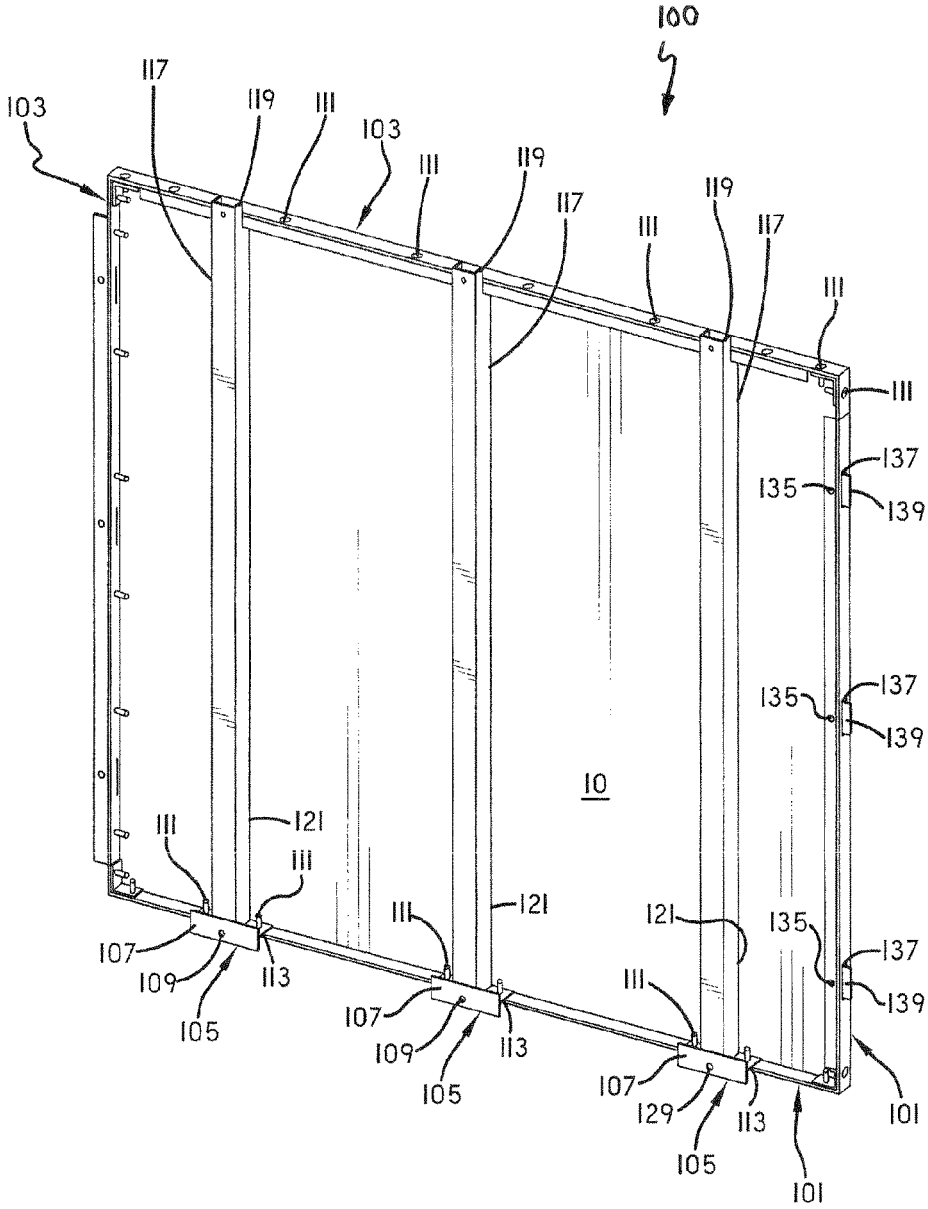
FIG. 2 is a perspective view of a portion of a first preferred embodiment architectural panel attachment system of the present invention, showing the underside of a terminating composite panel and showing three terminal base brackets cooperating with three terminal vertical tube stiffeners along with a terminal female bracket cooperating with three terminal male clips.
Figure 3:
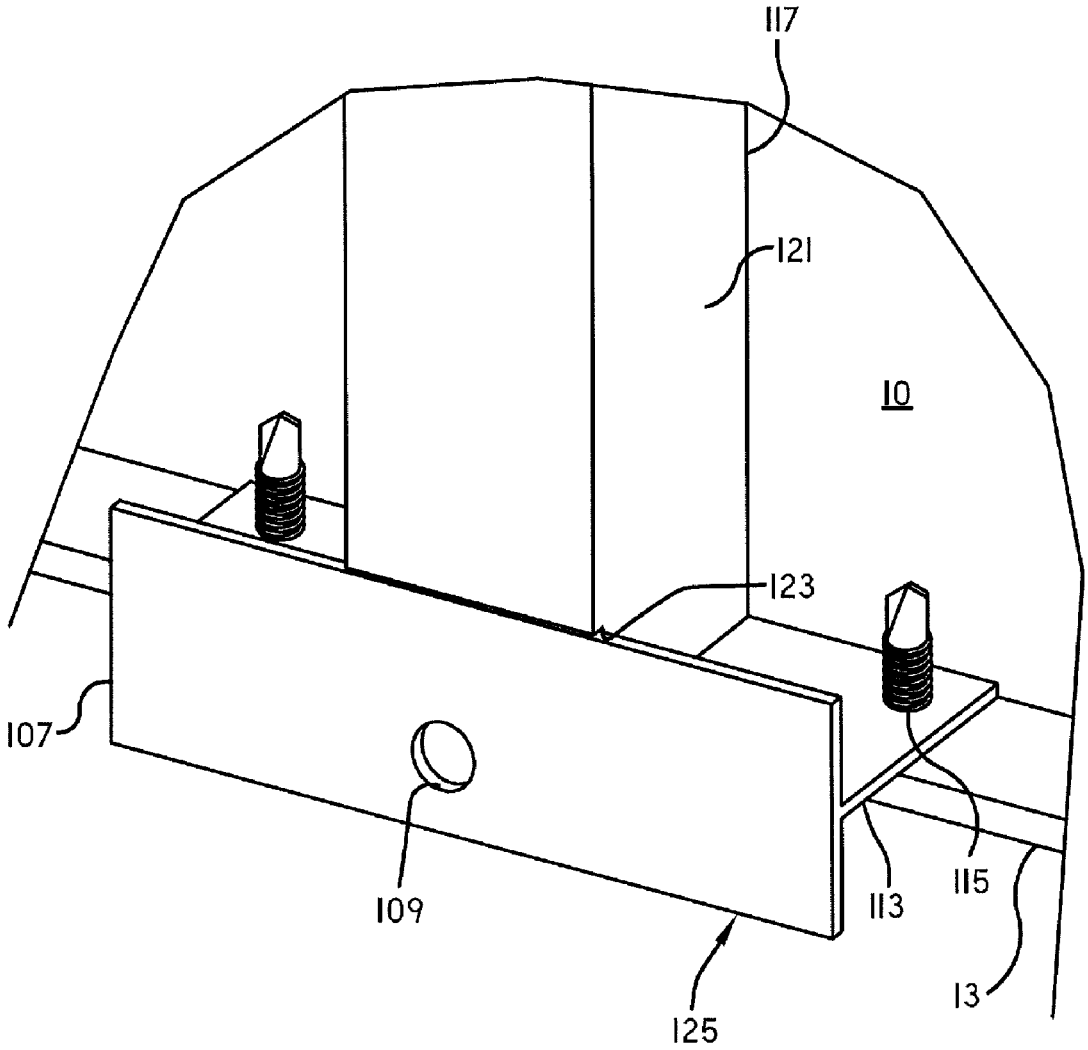
FIG. 3 is an enlarged perspective view of a portion of the first preferred embodiment architectural panel attachment system shown in FIG. 2, showing a terminal base bracket cooperating with a terminal vertical tube stiffener.
Figure 4:
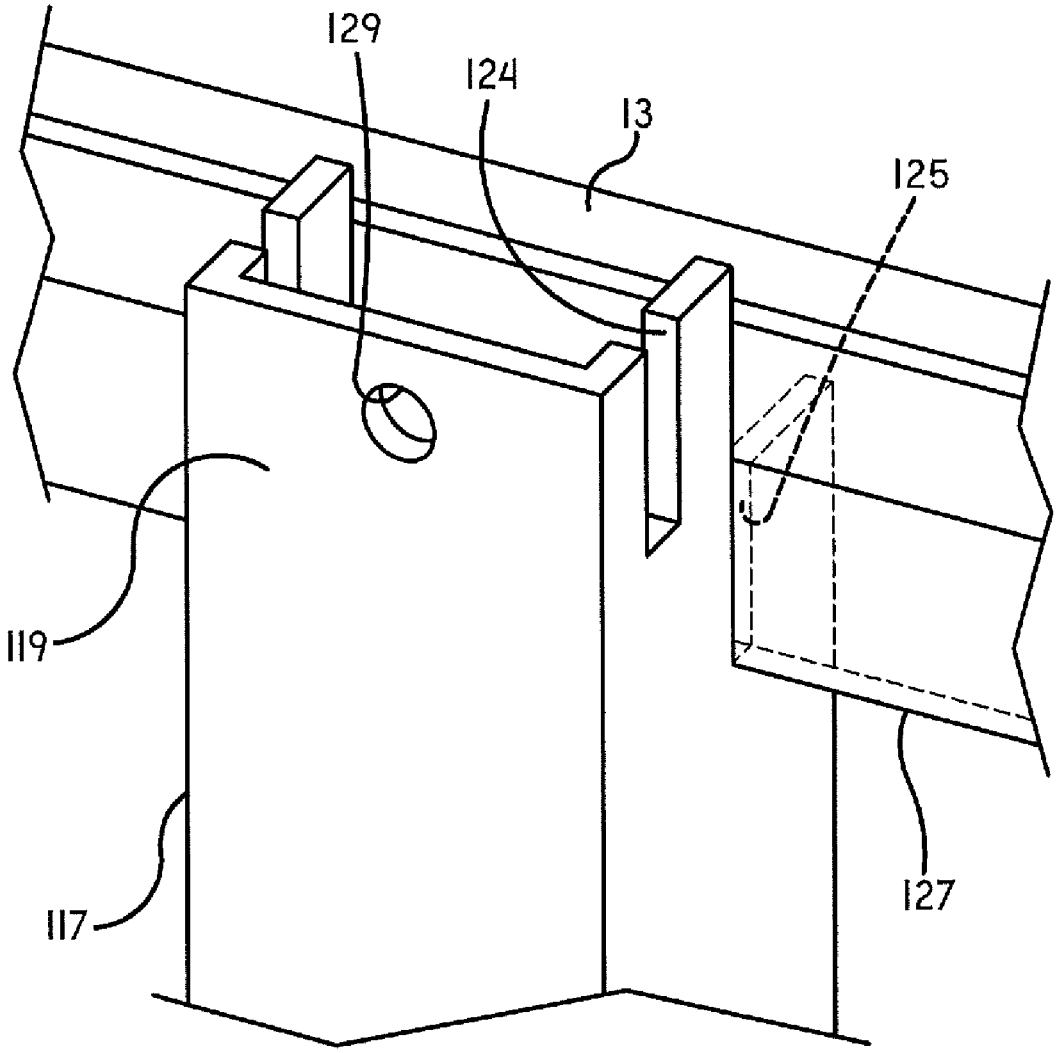
FIG. 4 is an enlarged perspective view of a portion of the first embodiment architectural panel attachment system shown in FIG. 2, showing the upper portion of the terminal vertical tube stiffener and angle support.
Figure 5:
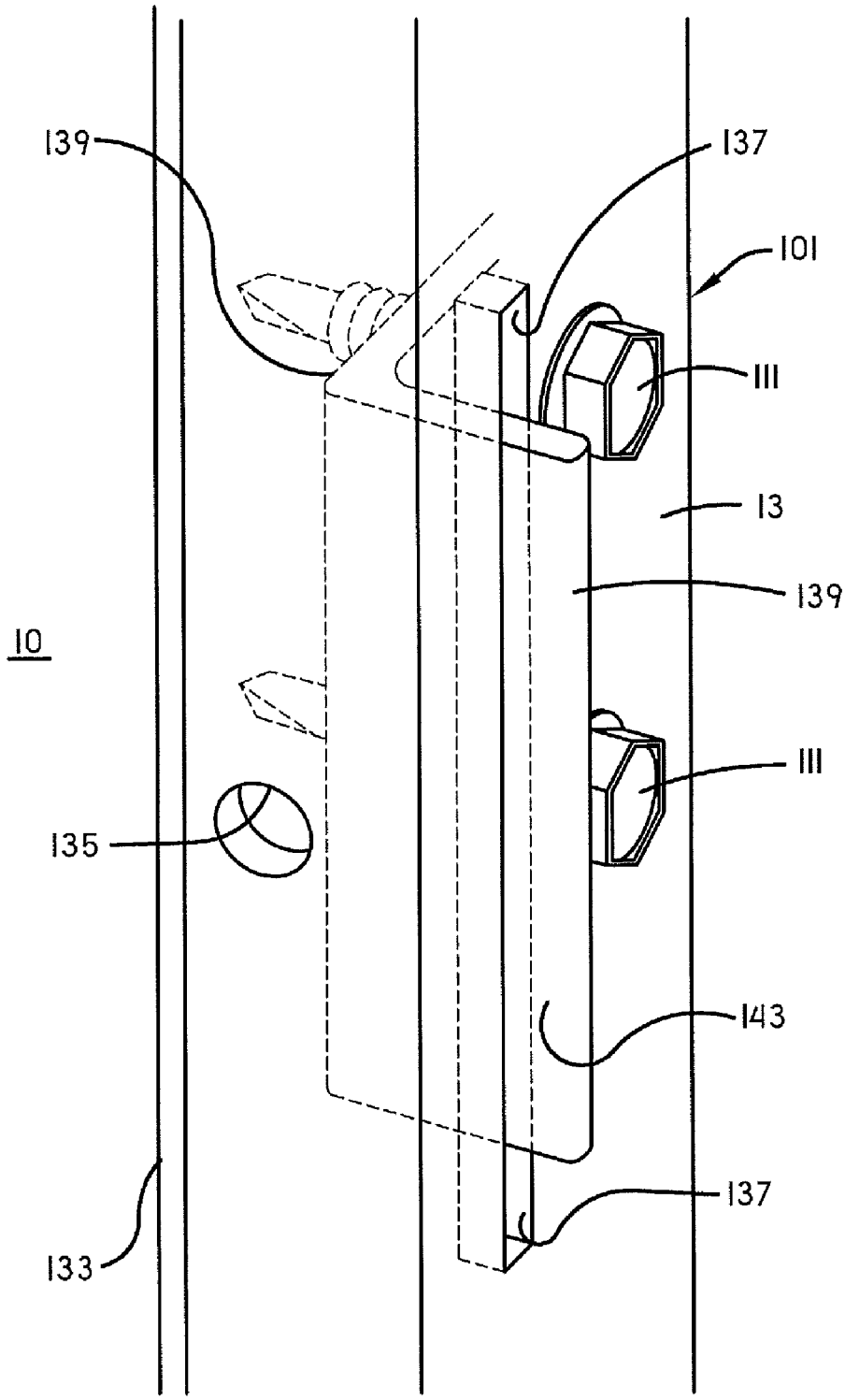
FIG. 5 is an enlarged perspective view of a portion of the first preferred embodiment architectural panel attachment system shown in FIG. 2, showing the terminal male clip attached to the composite panel and cooperating with the terminal female bracket which is attached to the building (not shown)

Turning now to FIG. 2, composite panel 10 having a pair of terminal sides 101 and a pair of non-terminal sides 103 is shown. First embodiment attachment system 100 of the present invention which attaches composite panel 10 to the exterior of a building includes three terminal base brackets 105. Terminal base brackets 105 have a generally T-shaped cross section and include a generally rectangular wall mount portion 107 having an opening 109 for receipt of a screw(not shown) to attach the base bracket to the exterior wall of the building (not shown). Base extension 113 extends generally perpendicularly outwardly from wall mount 107 and includes a pair of openings 115 for receipt of screw 111 in order to attach the base extension to flange 13 of composite panel 10. First embodiment attachment system 100 also includes three vertically disposed terminal vertical tube stiffeners 117, each having a generally square-tubular shape and an upper and lower end 119 and 121, respectively. Lower end 121 includes a notch 123 which cooperates with wall mount 107 of terminal base bracket 105 (FIG. 3). Upper end 119 of terminal vertical tube stiffener 117 includes a first notch 124 and a second notch 125 (FIG. 4). Second notch 125 cooperates with an angle support 127 having a generally L-shaped cross section and which is disposed on the underside of upper flange 13 of composite panel 10 and which is attached thereto by screws 111. Upper end 119 of terminal vertical tube stiffener 117 also includes an opening 129 for receipt of a screw (not shown) to attach the upper end of the terminal vertical tube stiffener to the building. Terminal vertical tube stiffeners 117 further include an outer surface (not shown) which is adhered to aluminum skin 12 of composite panel 10 by any suitable means such as a silicon-based adhesive, Turning now to FIGS. 2 and 5, the first preferred embodiment attachment system 100 of the present invention further includes a terminal female bracket 133 which is a generally longitudinally-extending bracket having a generally L-shaped cross section and includes three openings 135 for receipt of a screw (not shown) for attaching the bracket to the exterior of the building (not shown). Female bracket 133 further includes three longitudinally-extending slots 137. Three terminal male clips 139, also having a generally L-shaped cross section, are spaced along terminal side 101 of composite panel 10 each of which include a pair of openings (not shown) for receipt of screws 111 to attach the clip to flange 13 of the composite panel (FIG. 5). Extension 143 of male clip 139 extends outwardly and through slot 137 of female bracket 133 which is attached to the building (not shown) as set forth above in order to hold composite panel 10 to the building.

Turning now to FIG. 9, the first preferred embodiment of attachment system 100 of the present invention further includes four corner brackets 143 which are a generally L-shaped bracket having a pair of openings (not shown) for receipt of screws 111 to attach the corner bracket to an inner surface 17 of flange 13.

Turning now to FIGS. 6 and 7, composite panel 10 having four non-terminal sides 103 is shown. First embodiment attachment system 100 of the present invention which is attached to panel 10 includes three vertically disposed vertical tube stiffeners 147, each having a generally square-tubular shape and an upper and lower end, 149 and 151, respectively. Lower end 151 includes a notch 153 which cooperates with a base clip 155. More particularly, base clip 155 is a generally T-shaped bracket which includes a pair of openings (not shown) for receipt of screws 111 to attach the base clip to composite panel 10 in a manner well known to those skilled in the art (FIG. 7). Base clip 155 includes an upper plate 159 and a lower plate 161. Upper Plate 159 cooperates with notch 153 of lower end 151 of vertical tube stiffener 147. Upper end 149 of vertical tube stiffener 147 includes a generally-U-shaped first notch 165 and a second notch 167. Second notch 167 cooperates with angle support 127 which is attached to the upper flange 13 of adjacent composite panel 10 a by screws 111, as set forth above. First notch 165 cooperates with lower plate 161 of base clip 155, the effect of which is to provide a slip-fit joint fit and to attach the two adjacent panels to the exterior surface of the building. Upper end 149 also includes an opening 163 for receipt of a screw (not shown) to attach the upper end of the vertical tube stiffener to the exterior surface of the building. As can be seen by comparing FIG. 7 to FIG. 4 upper end 149 of vertical tube stiffener 147 is identical to upper end 119 of terminal vertical tube stiffener 117. For that reason, vertical tube stiffener 147 and terminal vertical tube stiffener 117 are able to cooperate with one another using base clip 155 which allows the user of the first preferred embodiment attachment system of the present invention to transition from a terminating panel. Vertical tube stiffeners 147 further include an outer face (not shown) which is adhered to aluminum skin 12 of composite panel 10 by any suitable means, such as a silicon-based adhesive.

With continued reference to FIG. 6 and also FIG. 8, the first preferred embodiment of attachment system 100 of the present invention further includes a female bracket 171 which is a generally longitudinally-extending bracket having a generally L-shaped cross section and includes three openings 173 for receipt of screws (not shown) for attaching the bracket to the exterior of the building (not shown). Female bracket 171 further includes three spaced-apart, longitudinally-extending slots 175. Three male clips 177, also having a generally L-shaped cross section, are spaced along side 103 of composite panel 10, each of which include a pair of openings (not shown) for receipt of screws 111 to attach the clip to flange 13 of the composite panel. Extension plate 181 of male clip 177 extends outwardly and through slot 175 of female bracket 171 attached to adjacent composite panel 10*a* in order to hold composite panels 10 and 10*a* to the building (FIG. 8).

With continuing reference to FIG. 6, the first preferred embodiment of attachment system 100 of the present invention further includes four corner brackets 143 which are generally L-shaped bracket having a pair of openings (not shown) for receipt of screws 111 to attach the corner bracket to an inner surface 17 of flange 13, and as best shown in FIG. 9.

By duplicating the above-described attachment system as for adjacent composite panels 10 and 10*a*, whether having terminal or non-terminal sides 101, 103, the composite panels can be quickly and easily attached to one another and to the exterior surface of the building as shown in FIG. 10.

Turning now to FIGS. 12 and 13, a second preferred embodiment of the composite panel attachment system of the present invention is indicated generally at 200, and is shown attached to composite panels 10 of the type shown in FIG. 1. Second preferred embodiment attachment system 200 of the present invention is similar in certain respects to first preferred embodiment attachment system 100 described above but is also different in certain other respects, the main difference being that the second preferred embodiment attachment system does not include either terminal or regular vertical tube stiffeners, as this second embodiment is generally used on buildings in geographic regions where there is no threat of hurricane exposure. Like first preferred embodiment attachment system 100 described in detail above, second preferred embodiment attachment system 200 includes both terminal and non-terminal support components for composite panels 10. Second preferred embodiment attachment system 200 of the present invention also generally includes both vertical and horizontal support components. As set forth above, vertical support components are those components that resist movement of composite panels 10 in a vertical plane V. Horizontal support components are those support components that resist movement of composite panel 10 in a horizontal plane H. Also, like first preferred embodiment attachment system 100 second preferred embodiment attachment system 200 is also formed form aluminum or other suitable robust material unless otherwise noted.

With continuing reference to FIG. 12, composite panel 10 having a pair of terminal sides 101 and a pair of non-terminal sides 103 is shown. Second preferred embodiment attachment system 200 of the present invention which is utilized to attach composite panel 10 to the exterior surface of the building includes a pair of terminal female brackets 233 which cooperate with three terminal male clips 239 attached to composite panel 10 at flange 13 and a pair of non-terminal female brackets 271 which cooperate with three male clips 277 attached to an adjacent composite panel 10.

Turning now to FIG. 13, a group of composite panel 10 having only non-terminal sides 103 is shown utilizing second preferred embodiment attachment system 200 of the present invention. As set forth above, second preferred embodiment attachment system 200 includes a pair of female brackets 271 disposed on each one of a pair of adjacent non-terminal sides 103 of composite panel 10. Female brackets 271 include spaced-apart slots 275. Male clips 277 are similarly spaced-apart and disposed on the remaining two adjacent non-terminal sides 203 of composite panel 10. Male clips 277 attached to composite panel 10 cooperate with female brackets 271 attached to adjacent composite panels 10 in a manner well known to those skilled in the art. Likewise, female brackets 271 attached to composite panel 10 cooperate with spaced apart male clips 277 attached to adjacent composite panels 10*a*.

By arranging composite panels adjacent to one another in the manner described in the second preferred embodiment attachment system of the present invention detailed above, the composite panels are attached to the exterior surface of the building while still allowing expansion and contraction joints for the panels.

It is contemplated by the present invention that other shapes and sizes of the components of the attachment system of the present invention could be utilized without affecting the overall concept of the invention. For example, vertical tube stiffeners 117, 147 could also have a generally I, C or U-shaped cross-section. Also, varying numbers of each of the components of the attachment system could be utilized along with varying lengths between each of the components, such as vertical tube stiffeners 117, 147, slots 137, 175, 275, and male clips 139, 239 being placed at distances less than or greater than 16 inches on center from one another. Moreover, the attachment system of the present invention has been described in connection with a specific type of architectural panel, mainly aluminum composite panels, with the understanding that other types of architectural panels could be utilized in conjunction with the invention, such as solid aluminum or copper panels and the like without affecting the overall concept of the invention.

The present invention has been described with reference to specific embodiments. It is to be understood that this illustration is by way of example and not by way of limitation. Potential modifications and alterations will occur to others upon a reading and understanding of this disclosure, and it is understood that the invention includes all such modifications and alterations and equivalents thereof.

Accordingly, the improved system for attaching prefabricated architectural panels of the present invention is simplified, provides an effective, safe, inexpensive, and efficient system for attaching prefabricated architectural panels which achieves all the enumerated objectives, provides for eliminating difficulties encountered with prior art systems, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved system for attaching prefabricated architectural panels is constructed, arranged and used, the characteristics of the construction and arrangement, and the advantageous, new and useful results obtained; the new and useful structures, devices, elements, arrangements, parts and combinations, and methods are set forth in the appended claims.

What is claimed is:

1. A system for attaching architectural panels comprising:

a) at least one stiffener fixedly attached to a panel and to an outer surface of a building, said stiffener interlocking with a base clip fixedly attached to an adjacent panel, the stiffener being an elongated rectangular shape having a first end and a second end, said first end being formed with a notch, said second end being formed with a notch and an opening;

b) a bracket being formed with an elongated opening, said bracket being attached to a first edge portion of said panel;

c) a first clip attached to a second edge portion of said panel;

d) said opening of said bracket interlocking with a second clip attached to a first adjacent panel, said first clip interlocking with a second bracket of a second adjacent panel, for attaching said panel to said building.

2. The system for attaching architectural panels of claim 1, said stiffener being adhesively bonded to said panel.

3. The system for attaching architectural panels of claim 1, said elongated opening of said bracket further comprising a plurality of spaced-apart elongated openings.

4. The system for attaching architectural panels of claim 1, further comprising an edge stiffener attached to an upper portion of said panel.

5. The system for attaching architectural panels of claim 1, further comprising a corner bracket attached to each one of a plurality of corners being formed in said panel.

6. The system for attaching architectural panels of claim 1, said first clip having a generally L shape.

7. The system for attaching architectural panels of claim 1, said first clip further comprising a pair of spaced apart clips.

8. The system for attaching architectural panels of claim 1, said panel having a flange extending outwardly toward said outer building surface.

9. The system for attaching architectural panels of claim 1, said base clip further comprising a plurality of spaced apart base clips having a generally T shape.

10. A method for attaching architectural panels to an outer surface of a building including the steps of:

a) attaching a first base clip to a first edge of a first panel;

b) attaching a stiffener to said first panel; said stiffener interlocking with said first base clip;

c) attaching a first bracket having an elongated opening to a second edge of said first panel;

d) attaching a first clip to a third edge of said first panel;

e) interlocking said stiffener with a second base clip attached to an edge portion of an adjacent panel;

f) interlocking said first clip with a second bracket having an elongated opening and being attached to an edge of an adjacent panel;

g) interlocking said first bracket with a second clip attached to an edge of an adjacent panel; and h) attaching an end portion of said stiffener to said outer surface of said building.

* * * * *